United States Patent [19]

Kuwabara et al.

[11] 4,020,626

[45] May 3, 1977

[54] ELECTRONIC TIMEPIECE

[75] Inventors: Tsuneo Kuwabara; Kouzo Yokoyama, both of Tokyo; Takenobu Kobori, Kawasaki, all of Japan

[73] Assignee: Kabushiki Kaisha Daini Seikosha, Japan

[22] Filed: May 14, 1975

[21] Appl. No.: 577,166

[30] Foreign Application Priority Data

May 14, 1974 Japan ..... 49-53543

[52] U.S. Cl. ..... 58/23 R; 58/85.5; 328/17

[51] Int. Cl.[2] ..... G04B 27/08; G04C 3/00

[58] Field of Search ..... 58/23 R, 50 R, 85.5, 58/33; 328/17, 18

[56] References Cited

UNITED STATES PATENTS

| | | | |
|---|---|---|---|
| 3,777,471 | 12/1973 | Koehler et al. | 58/23 R |
| 3,810,356 | 5/1974 | Fujita | 58/23 R |
| 3,812,669 | 5/1974 | Wiget | 58/23 R |
| 3,817,023 | 6/1974 | Kashio | 58/85.5 |
| 3,823,545 | 7/1974 | Vittoz et al. | 58/23 R |
| 3,834,152 | 9/1974 | Nishimura et al. | 58/23 R |
| 3,852,951 | 12/1974 | Sauthier | 58/23 R |
| 3,855,782 | 12/1974 | Nishimura et al. | 58/23 R |
| 3,886,726 | 6/1975 | Williams et al. | 58/50 R |
| 3,889,459 | 6/1975 | Lu | 58/50 R X |
| 3,889,460 | 6/1975 | Yasukawa et al. | 58/23 R |
| 3,895,486 | 7/1975 | Hammer et al. | 58/23 R |
| 3,913,312 | 10/1975 | Numabe | 58/50 R |
| 3,922,844 | 12/1975 | Sakamoto | 58/23 R |
| 3,931,703 | 1/1976 | Scherrer et al. | 58/23 R |

*Primary Examiner*—Stanley J. Witkowski
*Attorney, Agent, or Firm*—Robert E. Burns; Emmanuel J. Lobato; Bruce L. Adams

[57] ABSTRACT

An electronic timepiece comprises a quartz oscillator, a dividing circuit, a preset circuit connected to receive and divide the output pulses of the oscillator and a control circuit. The dividing circuit includes a first counter and a second counter. The preset circuit includes a setting circuit connected to an externally actuated switch, a memory circuit memorizing the number of switching times of the setting circuit caused by actuation of the switch, and a control setting circuit for presetting the complement of the memorized content of the memory circuit in the first counter. The second counter receives outputs from flip-flops constituting the first counter and produces an output which is applied to the control circuit which in turn produces an adjustment signal to the control setting circuit. The variation of the frequency of the quartz oscillator is precisely adjusted by changing the dividing ratio of said dividing circuit.

3 Claims, 3 Drawing Figures

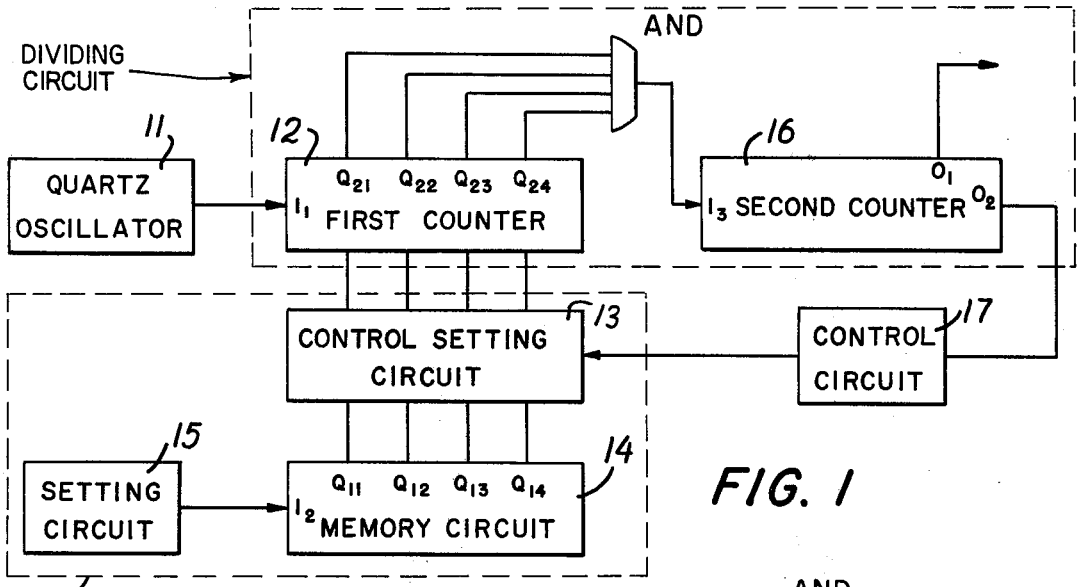
FIG. 1
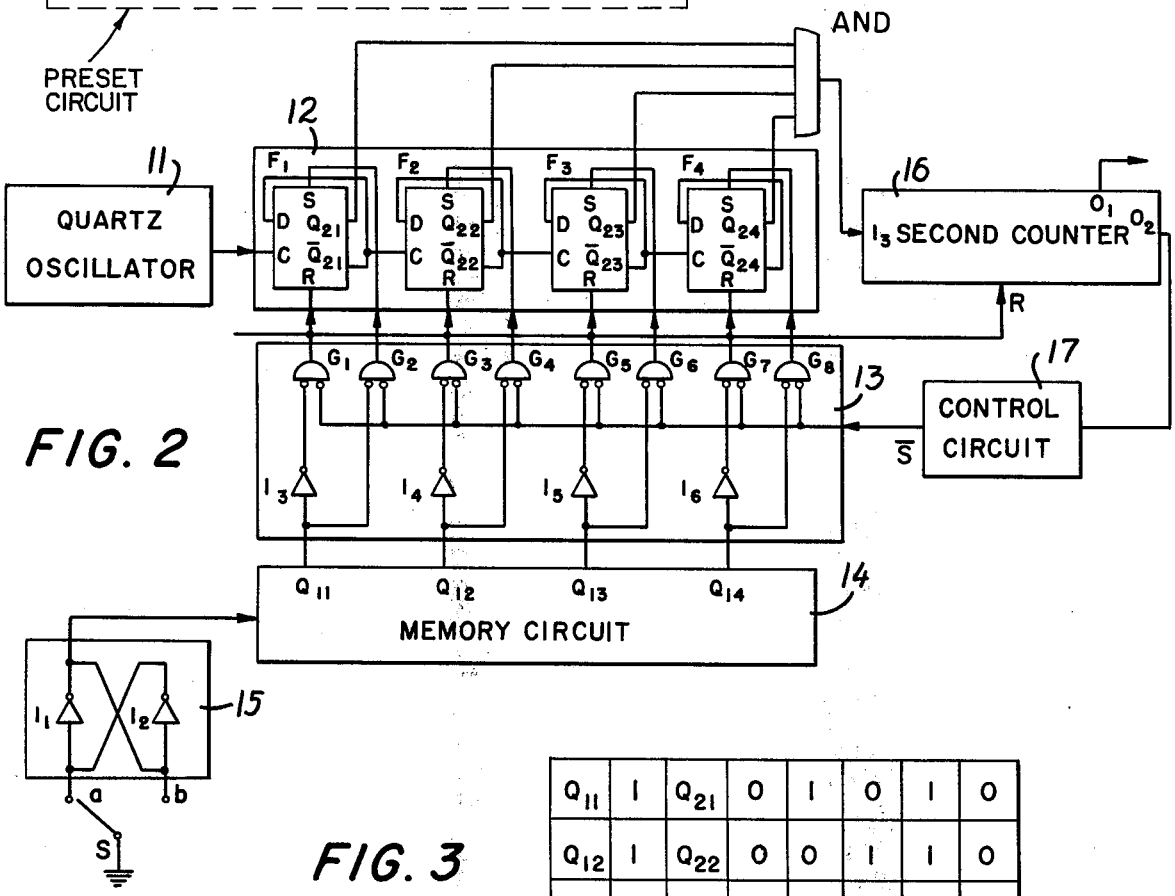
FIG. 2
FIG. 3
| | | | | | | | |
|---|---|---|---|---|---|---|---|
| $Q_{11}$ | 1 | $Q_{21}$ | 0 | 1 | 0 | 1 | 0 |
| $Q_{12}$ | 1 | $Q_{22}$ | 0 | 0 | 1 | 1 | 0 |
| $Q_{13}$ | 0 | $Q_{23}$ | 1 | 1 | 1 | 1 | 0 |
| $Q_{14}$ | 0 | $Q_{24}$ | 1 | 1 | 1 | 1 | 0 |
| | | | | A | B | C | D |
A... First Pulse
B... Second Pulse
C... Third Pulse
D... Fourth Pulse

ELECTRONIC TIMEPIECE

BACKGROUND OF THE INVENTION

This invention relates to an electronic timepiece, and more particularly to a high precision electronic timepiece in which variations of the frequency of a quartz oscillator are compensated by adjustably changing the dividing ratio of a dividing circuit to produce a predetermined time signal.

The quartz oscillators which have been conventionally produced do not always generate pulses at constant frequency. The quartz oscillator is typically trimmed by means of a laser in order to remove remove and to adjust for any variation of the frequency thereof. However, there is a disadvantage in that such a trimming operation is difficult and expensive.

Then, it has been proposed that the variation of the frequency of the quartz oscillator may be adjusted by making it possible to adjustably change the dividing ratio of the dividing circuit which is connected to the quartz oscillator circuit in consideration of the variation of the frequency thereof.

In this case, a time signal is produced when the count value of a counter which counts output pulses of the quartz oscillator is coincident to the memory value of a memory circuit counting and memorizing the output pulses of the quartz oscillator which are generated in a fundamental time determined by utilizing a high precision external or outside time standard reference signal.

However, in the above-mentioned case, disadvantages still remain in that the high precision time standard reference signal from the outside is needed together with a coincidence circuit which includes many terminals, and therefore is difficult to miniaturize and manufacture such circuits in integrated form.

SUMMARY OF THE INVENTION

An electronic timepiece having a quartz oscillator produces a precise time signal which is compensated for little variations of the frequency of the quartz oscillator.

It is therefore an object of the present invention to eliminate above-mentioned drawbacks and to provide an electronic timepiece where the variation of the frequency of a quartz oscillator is precisely adjusted by making it possible to adjustably change the dividing ratio of the dividing circuit connected to the oscillator to produce a precise time signal by receiving outputs from the quartz oscillator itself.

BRIEF DESCRIPTION OF THE DRAWINGS

For a fuller understanding of the invention, reference is had to the following description taken in connection with the accompanying drawings, in which:

FIG. 1 is a block diagram showing an embodiment of the present invention;

FIG. 2 is a circuit diagram showing in detail a part of the block diagram shown in FIG. 1; and FIG. 3 shows output states of a memory circuit and a counter shown in FIG. 1.

DESCRIPTION OF THE PREFERRED EMBODIMENTS

Referring to FIG. 1, there is shown an electronic timepiece according to the present invention. The electronic timepiece comprises a quartz oscillator 11 producing high frequency output pulses suitable as a time standard, a dividing circuit including an adjustably settable first counter 12 and a second counter 16, and adjusting means for selectively adjusting the dividing ratio of the dividing circuit to accordingly adjust the frequency of the output pulses. The adjusting means comprises a preset circuit connected to the dividing circuit and including a setting circuit 15, a memory circuit 14 and a control setting circuit 13. The setting circuit 15 is connected to the memory circuit 14 which counts and memorizes the number of pulses produced by a switching operation of the setting circuit. The memory circuit 14 is connected to the control setting circuit 13 which presets the memorized content of the memory circuit 14 for the first counter 12. The first counter comprises a plurality of flip-flops connected in cascade and from respective outpet terminals of which are produced signals which are in turn applied through an AND gate to the second counter 16. A control circuit 17 is connected to the second counter 16 and is actuated by an output signal from the terminal $O_2$ of the second counter 16 to control the control setting circuit 13.

The operation of the electronic timepiece according to the present invention will be fully described in connection with FIG. 2. In the preset circuit comprising the setting circuit 15, the memory circuit 14 and the control setting circuit 13, the memory circuit 14 memorizes the number of switching times or actuations of a switch connected to the setting circuit 15. For example, if the memory circuit 14 memorizes in logic form 3 switching times, the output state of respective output terminals $Q_{11}$, $Q_{12}$, $Q_{13}$, $Q_{14}$ of a plurality of flip-flops constituting the memory circuit 14 becomes 1 1 0 0 as shown in FIG. 3. These outputs are applied to gates $G_2$, $G_4$, $G_6$, $G_8$ of the control setting circuit 13 and the inverted signals of these outputs which are inverted through inverters $I_3$, $I_4$, $I_5$, $I_6$ are applied to gates $G_1$, $G_3$, $G_5$,$G_7$. It is to be noted that the output state at the output terminals $Q_{21}$, $Q_{22}$, $Q_{23}$, $Q_{24}$ of flip-flops $F_1$, $F_2$, $F_3$, $F_4$ constituting the first counter 12 is preset in 0 0 1 1 when the output signal $\overline{S}$ of the control circuit 17 is a logic 0. Simultaneously, the output signal $\overline{S}$ of the control circuit 17 changes to the logic 1. Continuing with this example, the next three pulses from the quartz oscillator 11 are applied to the first counter 12 so that respective output terminals of flip-flops $F_1$, $F_2$, $F_3$, $F_4$ of the first counter 12 become 1 1 1 1 as shown in FIG. 3. At this time, an output signal is generated from the AND gate and is applied to an input terminal $I_3$ of the second counter 16. When a fourth pulse from the quartz oscillator 11 is applied to the first counter 12, the output terminals $Q_{21}$, $Q_{22}$, $Q_{23}$, $Q_{24}$ of the first counter become 0 0 0 0, respectively. Further, when seven pulses are applied to the input terminal of the first counter 12, the content of the first counter again becomes 1 1 1 1, and a signal is again applied to the second counter 16. In this manner, while the input terminal of the first counter 12 is contiuously applied with pulses, the output terminal $O_1$ of the second counter 16 produces a time signal in the form of precise time pulses. After that, when subsequent pulses are applied to the input terminal of the first counter, the output terminal $O_2$ of the second counter 16 produces an adjustment signal so that the control circuit 17 is actuated. As a result, the logic of the output signal S of the control circuit 17 changes to 0, and the logic complement of 0 0 1 1 of the memorized content 1 1 0 0 of the memory circuit 14 presets again the first counter 12. Once again, the output pulses from the quartz oscillator cause the same operation.

It is appreciated that even if the frequency of the quartz oscillator undergoes variations to some extent, it is periodically adjusted by the adjustment signal from the output terminal $O_2$ of the second counter 16.

Accordingly, if the adjustment signal is generated from the output terminal $O_2$ of the second counter after T-seconds from that when the output signal of the quartz oscillator 11 is applied to the first counter 12, the dividing ratio of the first counter changes every T-seconds.

As mentioned above, according to the present invention, the variation of the frequency of the quartz oscillator may be adjusted by switching control of the setting circuit and the circuit construction is largely simplified because of a simple combination of the memory circuit 14, the setting control circuit 13 and the first counter 12.

Further, since the amount of adjustment of the variation of the output frequency of the quartz oscillator is determined by the number of switching times of the setting circuit 13, the adjustment operation of the electronic timepiece according to the present invention is easily performed.

What is claimed is:

1. In an electronic timepiece: a quartz oscillator for producing high frequency pulses suitable as a time standard; a dividing circuit connected to said quartz oscillator to receive therefrom the high frequency pulses and divide them into lower frequency pulses, said dividing circuit comprising adjustably settable first counting means for counting an adjustably set predetermined number of high frequency pulses and thereafter providing an output pulse, and second counting means receptive of the output pulses from said first counting means for counting a predetermined number thereof and thereafter providing an output time pulse; adjusting means for selectively adjusting the dividing ratio of said dividing circuit to accordingly adjust the frequency of the output time pulses, said adjusting means comprising a selectively actuatable switch, and means for memorizing the number of times said switch has been actuated and presetting said first counting means comprising a preset circuit including a memory circuit for memorizing in logic form the number of times said switch has been actuated and a control setting circuit operative to preset the logic complement of the memorized content of said memory circuit in said adjustably settable first counting means to thereby selectively adjust the number of high frequency pulses counted by said first counting means and accordingly control the frequency of the output time pulses to thereby adjust for variations in the output of said quartz oscillator; and means including a control circuit connected to said second counting means and responsive to output pulses therefrom to periodically produce an adjustment signal and apply the same to said control setting circuit to effect periodic resetting of said adjustably settable first counting means.

2. An electronic timepiece according to claim 1; wherein said memory circuit includes a plurality of flip-flops connected so as to memorize in logic form the number of times said switch has been actuated and apply the memorized content thereof to said control setting circuit.

3. An electronic timepiece according to claim 1; wherein said adjustably settable first counting means comprises a plurality of flip-flops connected in cascade to receive the high frequency pulses from said quartz oscillator and divide them into lower frequency pulses; and said control setting circuit includes means for resetting said flip-flops with the logic complement of the memorized content of said memory circuit to thereby adjustably set said first counting means.

* * * * *